United States Patent [19]

Nakamura et al.

[11] Patent Number: 4,466,007

[45] Date of Patent: Aug. 14, 1984

[54] HEAT-SENSITIVE RECORDING PAPER

[75] Inventors: Sukenori Nakamura; Akira Igarashi, both of Shizuoka, Japan

[73] Assignee: Fuji Photo Film Co., Ltd., Kanagawa, Japan

[21] Appl. No.: 434,694

[22] Filed: Oct. 15, 1982

[30] Foreign Application Priority Data

Oct. 16, 1981 [JP] Japan ..... 56-165264

[51] Int. Cl.[3] ..... B41M 5/18

[52] U.S. Cl. ..... 346/200; 346/207; 428/409; 428/537.5

[58] Field of Search ..... 282/27.5; 427/150–152; 428/211, 320.8, 411, 537, 488, 913, 914, 409, 323, 336

[56] References Cited

U.S. PATENT DOCUMENTS 4,032,690 6/1977 Kohmura et al. ..... 428/537

4,098,114 7/1978 Asao et al. ..... 428/914

*Primary Examiner*—Bruce H. Hess

*Attorney, Agent, or Firm*—Sughrue, Mion, Zinn, Macpeak and Seas

[57] ABSTRACT

A heat-sensitive recording paper having a heat-sensitive color-forming layer on the glossy surface of a support base comprised of raw paper manufactured with a Yankee machine is disclosed. The paper has improved surface smoothness and back side roughness because the raw paper used was manufactured with the Yankee machine. The heat-sensitive recording paper produces an image with increased density without increased fogging.

8 Claims, No Drawings

HEAT-SENSITIVE RECORDING PAPER

FIELD OF THE INVENTION

The present invention relates to a heat-sensitive recording paper, and more particularly to a heat-sensitive recording paper which can exhibit improved recording characteristics when producing an image in connection with a thermal head or the like.

BACKGROUND OF THE INVENTION

The term "heat-sensitive recording paper" means a recording paper of the kind which forms an image by physical or chemical changes of some of its constituents caused by applying thermal energy. A large number of such processes have been studied.

There are a number of known processes for utilizing a physical change caused in a certain substance by the application of heat, an example of which is the so-called wax type heat-sensitive recording sheet. These sheets are used for recording electrocardiograms and so on. There are also a number of known processes which utilize chemical changes caused by heat. For instance, one process takes advantage of a particular compound which undergoes coloration upon the application of heat. Another process takes advantage of a particular combination of substances which can react with one another under applied heat and form a color. Specific examples of combinations which can effect a color reaction when heat is applied include combinations of ferric salts of higher fatty acids such as stearic acid or the like with polyhydroxy aromatic compounds as described in U.S. Pat. Nos. 2,663,654, 2,663,655, 2,663,656, 2,663,657, and so on, those comprised of starting materials for producing dyes such as azo dyes or oxazine dyes as described in Japanese Patent Publication No. 9,240/63 and so on, and those comprised of colorless dyes such as Crystal Violet lactone and the like with phenolic compounds as described in U.S. Pat. No. 3,539,375, and so on.

All of these heat-sensitive recording papers have color reactions which obey a first-order kinetics. Therefore, a developing step is not required. Such being the case, these heat-sensitive papers are desirable because the recording apparatus therefor can be made light weight and miniaturized. These advantages have recently caused a rapid increase in the demand for using these heat-sensitive recording papers. However, these heat-sensitive recording papers are not desirable because of their slow response speeds. In order to carry out high speed recording, a large amount of heat energy must be applied on the heat-sensitive recording paper in a short time because the amount of heat energy per unit area necessary for recording is constant. However, the recording element has a limited recording energy depending on the power of source.

Various means have been devised to eliminate these defects by altering the recording apparatus and/or the recording paper. A typical example thereof is the improvement upon the surface smoothness of the heat-sensitive recording paper as described in Japanese Patent Publication No. 20142/77, and Japanese Patent Application (OPI) No. 47351/73 (The term "OPI" as used herein refers to a "published unexamined Japanese patent application"). The smoothness of a heat-sensitive recording paper has, in general, been improved by subjecting the recording paper to a surface treatment such as super calendering or the like. The improvement in the surface smoothness increases the heat transfer efficiency between the recording element and heat-sensitive recording paper and contributes to a gain in the response speed of the paper.

However, such surface treatment cannot make the recording paper smooth without various disadvantages. One disadvantage is the occurrence of fog, that is, the color reaction which takes place in the course of the surface treatment resulting in undesired coloration in the recording paper. A proposed means of eliminating this disadvantage is the addition of grain-shaped wax. This was proposed in Japanese Patent Publication No. 14531/75 and U.S. Pat. Nos. 4,032,690 and 3,445,261. However, waxes usually have large heat capacities and require great heat upon fusion. Consequently, they retard the thermal response of the heat-sensitive recording papers.

Another disadvantage is a lowered facility with respect to writting with a pencil, a ball-point pen or the like. The reason for this disadvantage is obvious considering that such writting means functions through friction with paper.

Yet another disadvantage relates to a production problem. More specifically, the smoothening step is carried out using a super calender or the like operating independently of the main machine for producing the recording paper. Therefore, production efficiency is remarkably lowered.

Still another disadvantage is impediment to running of a recording paper on the recording element. More specifically, the recording paper sticks to the recording element at colored parts because the density of the heat-sensitive color-forming layer is greatly increased by the smoothening treatment. This causes the diffusion of heat fusable substance at the time of recording to be hindered in the direction of the interior of the coated layer.

However, because improved smoothness contributes to elevation of recording speed to a comparatively large extent such surface treatment is carried out at present, notwithstanding the various disadvantages described above.

SUMMARY OF THE INVENTION

A summary object of the present invention is to provide a heat-sensitive recording paper which does not suffer from the above-described disadvantages and results in improved heat transfer efficiency between the recording element and the recording paper.

The objects of the present invention are attained with a heat sensitive-recording paper having a heat-sensitive color-forming layer on the glossy surface of a support base comprised of raw paper manufactured with a Yankee machine.

DETAILED DESCRIPTION OF THE INVENTION

A Yankee machine which is used in connection with the present invention is a kind of paper machine. A Yankee machine is generally used for manufacturing tissue paper having a marked glossiness on one side and a roughness on the other side, as described in detail in *Pulp to Kami* (Pulp and Paper), pp. 341 to 342, Maruzene Co. Ltd., Tokyo (1957) and *Paper, Its Making, Merchanting and Usage,* E. W. Haylock, J.P., pp. 87 to 89, The Nationl Association of Paper Merchants (1974).

Paper manufactured with a Yankee machine as described in above latter reference, which is preferably employed in the present invention, has a Bekk smoothness of 50 seconds or above, more preferably 70 seconds or above, on its glossy surface, and a Bekk smoothness ranging from not more than 50 seconds to not less than 5 seconds, more preferably from not more than 30 seconds to not less than 5 seconds, on the back surface.

On the back surface of the raw paper, a binder or a pigment dispersed coating solution may be coated in order to prevent curling. Further, the glossy surface may be subjected to a surface treatment such as surface sizing or coating, if necessary.

Pulp for manufacturing the raw paper of the present invention include wood pulps and mixtures of wood pulps with synthetic pulps.

When a heat-sensitive color-forming layer is provided on the glossy surface of raw paper having such properties as described above (which are acquired by the use of a Yankee machine during manufacturing), sufficient planeness is imparted to the heat-sensitive color-forming layer without introducing any special treatments to impart smoothness, e.g., a super calendering or the like. In addition, due to the roughness of the back surface, sufficient frictional force exists between the recording paper and a roller or the like installed in a recording apparatus for forwarding recording papers. Accordingly, undesirable running due to a sticking phenomenon or the like can be kept to a minimum. The heat-sensitive recording paper of the present invention which includes raw paper manufactured with a Yankee machine has great advantages without the defects inherent in conventional heat-sensitive recording papers. Conventional papers receive calendering processing in order to improve their recording characteristics. However, such processing can create slipping problems in the traveling system of a recording apparatus.

Heat-sensitive coating compositions used in producing the present invention contain water as a dispersion medium. The heat-sensitive color-forming material of the present invention is in the form of fine particles dispersed in a dispersion medium. More specifically, the dispersion includes an electron donating colorless dye like Crystal Violet lactone and an electron accepting compound like 2,2-bis(4-hydroxyphenyl)propane dispersed in the form of fine particles measuring several microns or less in size in an aqueous solution of polyvinyl alcohol. Preparation processes for such dispersions are described in Japanese Patent Publication No. 14039/70, Japanese Patent Application (OPI) Nos. 93492/80 and 14281/80, and so on. Dispersed particles contained in the heat-sensitive coating composition are preferably controlled so as to have a volume average size of 8 μm or less, more particularly 4 μm or less. This particle size in preferred because the heat-sensitive color-forming layer is generally coated to a thickness of 5 to 10 μm. Therefore, if coarse grains are contained in this layer, sufficient smoothness cannot be obtained even when the raw paper of the present invention is employed.

The present invention will now be illustrated in more detail by reference to the following example. However, the present invention should not be construed as being limited to the following example.

EXAMPLE 20 kg of Crystal Violet lactone and 100 kg of a 10% aqueous solution of polyvinyl alcohol (having a saponification degree of 98% and a polymerization degree of 500) were placed in a 300 l ball mill and dispersed for about 24 hours. Similarly, 20 kg of 2,2-bis(4-hydroxyphenyl)propane and 100 kg of a 10% aqueous solution of polyvinyl alcohol were placed in a 300 l of ball mill, and dispersed for about 24 hours. The thus obtained dispersions were mixed in such a proportion that the ratio of the content of Crystal Violet lactone to that of 2,2-bis(4-hydroxyphenyl)propane was 1:5 by weight. Further, 5 kg of light and fine calcium carbonate was added to a 20 kg portion of the resulting mixture, and dispersed thoroughly to give a coating composition.

The heat-sensitive coating composition thus prepared was coated on glossy surfaces of three separate kinds of papers manufactured with a Yankee machine. Descriptions of the papers are set forth in Table 1. The coatings were applied in an amount of 6 g/m$^2$ as solids by means of an air knife coater. The coated papers were dried at 50° C. for 2 min. On each of the heat-sensitive coated layers, recording was carried out using a recording element to which energy of 2 ms/dot and 50 mJ/mm$^2$ was applied with a density of 5 dots/mm in the main scanning and 6 dots/mm in the subscanning. The reflection density was measured at 610 nm (corresponding to the wavelength at which the coloration body of Crystal Violet lactone exhibits its absorption maximum).

For comparison, the same steps were followed except that fine paper was used as the support. The paper was examined for recording characteristics under the same conditions as in the recording papers of the present example. The results obtained are shown in Table 1. Further, coloration densities of recording papers prepared using fine papers as supports which had received calendering processings were also examined. The results are also set forth in Table 1.

As can be seen from Table 1, heat-sensitive recording papers of the present invention exhibited very excellent recording characteristics.

TABLE 1

| | | Raw Paper Properties | | | Coated Paper Properties | | | |
|---|---|---|---|---|---|---|---|---|
| Support | | Weight (g/m$^2$) | Smoothness of Glossy Surface | Smoothness of Back Surface | Smoothness of Coated Surface | Smoothness of Back Surface | Recording Density | Remark |
| Raw Paper manufactured with Yankee Machine | (I) | 40.0 | 113 (sec) | 9 (sec) | 150 (sec) | 6 (sec) | 1.18 | Present Invention |
| Raw Paper manufactured with Yankee Machine | (II) | 51.8 | 91 | 6 | 134 | 5 | 1.29 | Present Invention |
| Raw Paper manufactured with Yankee | (III) | 49.7 | 72 | 6 | 112 | 5 | 1.20 | Present Invention |

TABLE 1-continued

| Support | | Raw Paper Properties | | | Coated Paper Properties | | | |
|---|---|---|---|---|---|---|---|---|
| | | Weight ($g/m^2$) | Smoothness of Glossy Surface | Smoothness of Back Surface | Smoothness of Coated Surface | Smoothness of Back Surface | Recording Density | Remark |
| Machine | | | | | | | | |
| Fine Paper | (I) | 50.6 | 72 | 67 | 142 | 36 | 0.85 | Comparison |
| Fine Paper | (II)* | 50.6 | 445 | 401 | 340 | 150 | 0.94 | Comparison |
| Fine Paper | (III)* | 52.3 | 120 | 104 | 225 | 53 | 0.89 | Comparison |

*Super Calender 300 kgW/cm × 10 m/min.

While the invention has been described in detail and with reference to specific embodiments thereof, it will be apparent to one skilled in the art that various changes and modifications can be made therein without departing from the spirit and scope thereof.

What is claimed is:

1. A heat-sensitive recording paper, comprising:

(a) a support base comprising raw paper manufactured with a Yankee machine having a glossy surface; and (b) a heat-sensitive color-forming layer on the glossy surface, wherein the side of the support base opposite the glossy surface is a rough surface, and wherein the glossy surface has a Bekk smoothness of 70 seconds or more and the rough surface has a Bekk smoothness of from 5 seconds to 30 seconds.

2. A heat-sensitive recording paper as claimed in claim 1, wherein the rough surface has a binder coated thereon.

3. A heat-sensitive recording paper as claimed in claim 1, wherein the rough surface has a pigment dispersed coating solution thereon.

4. A heat-sensitive recording paper as claimed in claim 1, wherein the support base is manufactured from a wood pulp.

5. A heat-sensitive recording paper as claimed in claim 1, wherein the support base is manufactured from a mixtured of wood pulps and synthetic pulps.

6. A heat-sensitive recording paper as claimed in claim 1, wherein the heat-sensitive color-forming layer comprising particles dispersed in a dispersion medium, wherein the particles have a volume average size of 8 μm or less.

7. A heat-sensitive recording paper as claimed in claim 6, wherein the particles have a volume average size of 4 μm or less.

8. A heat-sensitive recording paper as claimed in claim 7, wherein the heat-sensitive color-forming layer has a thickness of from 5 to 10 μm.

* * * * *